US006170186B1

(12) United States Patent
Reed

(10) Patent No.: US 6,170,186 B1
(45) Date of Patent: Jan. 9, 2001

(54) FIREARM SAFETY APPARATUS

(76) Inventor: Waymon Burton Reed, P. O. Box 545, Sherman, TX (US) 75091

( * ) Notice: Under 35 U.S.C. 154(b), the term of this patent shall be extended for 0 days.

(21) Appl. No.: 09/290,715

(22) Filed: Apr. 12, 1999

(51) Int. Cl.[7] ..... F41A 17/30; F41A 17/44; F41A 17/00

(52) U.S. Cl. ..... 42/70.11; 42/66

(58) Field of Search ..... 42/70.01, 70.11, 42/66

(56) References Cited

U.S. PATENT DOCUMENTS

| | | | | |
|---|---|---|---|---|
| 2,530,560 | * | 11/1950 | Young | 42/70.01 |
| 2,836,918 | * | 6/1958 | Pula et al. | 42/70.11 |
| 3,022,598 | * | 2/1962 | Wikstrom | 42/66 |
| 3,027,674 | * | 4/1962 | Mahan | 42/66 |
| 3,193,959 | * | 7/1965 | Jaycox | 42/70.11 |
| 3,208,176 | * | 9/1965 | Giles | 42/66 |
| 3,360,880 | * | 1/1968 | Finnegan | 42/66 |
| 3,378,943 | * | 4/1968 | Valburg | 42/70.11 |
| 4,486,966 | * | 12/1984 | Seehase | 42/1.01 |
| 4,776,123 | * | 10/1988 | Ascroft | 42/70.11 |
| 5,052,142 | * | 10/1991 | Mikus | 42/70.11 |
| 5,054,223 | * | 10/1991 | Lee | 42/70.11 |
| 5,070,635 | * | 12/1991 | Cvetanovich | 42/70.11 |
| 5,097,613 | * | 3/1992 | Miller et al. | 42/70.01 |
| 5,138,785 | * | 8/1992 | Paterson | 42/66 |
| 5,179,234 | * | 1/1993 | Cvetanovich | 42/70.11 |
| 5,315,778 | * | 5/1994 | Wolford | 42/70.11 |
| 5,347,739 | * | 9/1994 | Stuart | 42/70.11 |
| 5,410,832 | * | 5/1995 | Barnhart | 42/70.11 |
| 5,475,994 | * | 12/1995 | Briley, Jr. et al. | 70/34 |
| 5,950,344 | * | 9/1999 | Ross | 42/70.11 |
| 6,041,536 | * | 3/2000 | Samuels et al. | 42/70.11 |

FOREIGN PATENT DOCUMENTS

| | | | | |
|---|---|---|---|---|
| 4119617 | * | 12/1992 | (DE) | 42/66 |
| 2611882 | * | 9/1988 | (FR) | 42/70.11 |
| 86000396 | * | 1/1986 | (WO) | 42/70.11 |
| 92015835 | * | 9/1992 | (WO) | 42/70.11 |

* cited by examiner

*Primary Examiner*—Michael J. Carone
*Assistant Examiner*—Son T. Nguyen

(57) ABSTRACT

The present invention is a safety device that prevents a weapon from being fired. The invention consists of a hollow cylindrical block and an ejector. The hollow cylindrical block is manually placed in a weapon's firing chamber thus preventing the engaging of a live shell. The chamber block is removed from the firing chamber of a weapon by manually inserting the ejector into and through the firearm chamber block allowing the ejector to engage the backside of the chamber block skirt. There is a raised rim on the ejector cap that allows the weapon's bolt to engage and extract the ejector and firearm safety apparatus as one unit.

1 Claim, 4 Drawing Sheets

FIREARM SAFETY APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

Firearm safety is a major problem in the world today. Even though most weapons are manufactured with safety mechanisms they are not designed adequate enough to prevent injury or deaths by being discharged accidentally. Children are not schooled in the functions of firearms and smaller children use them as toys. Youngsters do not realize the danger of a weapon, thereby; hundreds of children and adults have been seriously injured or killed. Many policemen are wounded or killed with their own weapon each year. Guns are accidentally fired and result in injury or death to nearby persons. People take for granted that a weapon is unloaded when, in fact, they are loaded and result in people being injured, maimed or killed.

There are many gun safety devices in use today. One such device is a trigger lock. Trigger locks do prevent a weapon from being discharged. Most trigger locks are bulky and installation is time consuming. This prevents a person from using the firearm in a reasonable time frame.

Trigger guards are used on many firearms. Most trigger guards require the manipulation of a key or screw to place the weapon in a safety mode. Again, this is time consuming and very clumsy especially for a person with large hands or bad eyesight. The time that is required for removing a trigger guard could result in injury or death to the user.

Many safety devices are designed to have a rod inserted into the muzzle of a weapon and an attachment inserted in to the firing chamber connected to the rod and pulled or tightened to swell the attachment in the weapons firing chamber. Usually, this is accomplished by twisting the rod clockwise to lock and counter-clockwise to unlock, many are keyed. These type barrel devices are again, time consuming, expensive and could result in injury or death if an apparatus is being installed in a loaded weapon. A person in a hurried situation could conceivably remove the device inserted in the firing chamber and leave the rod in the barrel, chamber a round, and fire the weapon that could result in injury or death to the user.

Many devices have been invented to prevent firearms from being discharged. One such device described in U.S. Pat. No. 4,058,923, to Smith, shows a safety clip attached to the handgrip of a shotgun. The clip further extends upward and into the magazine. The clip then curls back and against the shell that is ready to be injected into the firing chamber. This system would prevent semi-automatic and automatic shotguns from being fired if there is no shell present in the firing chamber before the safety clip is installed. Mr. Smith's safety device would be of little use on other weapons. For example, the device could not be mounted to a single barrel weapon or a break-over shotgun.

U.S. Pat. No. 4,654,992, to Lavergne, shows a locking apparatus inserted into the magazine of a weapon with a frame extending upward with said frame having a keyed lock, when rotated, positions a lever down and into the ejection port. The art displayed by U.S. Pat. No. 4,654,992, to Mr. Lavergne, limits the use of the firearm safety device to magazine type firearms.

U.S. Pat. No. 4,965,952 and 5,097,613 to Miller, depicts a loaded, live semi-automatic rifle cartridge, as used by the U.S. Military M-16 Rifle. Further art displays a safety plug designed similar to the M-16's cartridge and manufactured by using certain plastics or alloy materials. The art displays a visual indicator tab protruding from the ejection port that allows visual inspection to determine if a live round has been injected into the firing chamber. The safety plug is of great benefit to allow visual inspection but can be easily removed by opening the breech and manually removing the tab and plug. After removing the plug a child, adult or perpetrator would be allowed to use the weapon.

Safety plugs, locking mechanisms, gun locking devices and chamber devices are disclosed in U.S. Pat. Nos. 5,014,457, 5,070,635, 4,995,180, 5,038,580, 5,419,069, 5,475,994 and 5,669,252.

Accordingly, it is the objective of the present invention to provide a Firearm Safety Apparatus for use in most all rifles, shotguns, semi-automatic and automatic weapons, and pistols.

REFERENCES CITED

| U. S. Pat. Documents | | | |
|---|---|---|---|
| 4058923 | Nov., 1977 | Smith | 421LP |
| 4654992 | Apr., 1987 | Lavergne | 42/70.01 |
| 4965952 | Oct., 1990 | Miller | 42/70.01 |
| 4995180 | Feb., 1991 | Tucker | 42/70.11 |
| 5014457 | May, 1991 | Lewis | 42/70.11 |
| 5038580 | Aug., 1991 | Brown | 42/70.11 |
| 5070635 | Dec., 1991 | Cvetanovich | 42/70.11 |
| 5097613 | Mar., 1992 | Miller | 42/70.01 |
| 5419069 | May, 1995 | Mumbleau | 42/70.11 |
| 5475994 | Dec., 1995 | Briley | 70/34 |
| 5669252 | Sept., 1995 | Briley | 70/34 |

BRIEF SUMMARY OF THE INVENTION

The object of the Firearm Safety Apparatus is to provide a safe, dependable and economically sound means to place a weapon in an inoperable mode until ready for use.

Another object of the invention is to provide a firearm safety apparatus device that can be uses on most all weapons.

A further object of the invention is to provide an easy method for securing a firearm to prevent injury or death.

Another object of the invention is to provide a method for securing a weapon by placing a blocking mechanism in the firing chamber to prevent the placement of a live shell and to remove the blocking device in a timely fashion allowing the weapon to be used.

Another object of the invention is to provide a safe means for securing a firearm by using the firearm chamber safety block as a chamber plug when used with the sleeve and ejector as one unit.

Another object of the invention is to provide a simple means for securing a firearm by providing a two-part unit, a sleeve and an ejector.

BRIEF DESCRIPTION OF THE DRAWINGS

A more detailed understanding of the present invention may be had by reference to the following detailed description when taken in conjunction with the drawings wherein.

DISCLOSURE OF THE INVENTION

Figure 1:
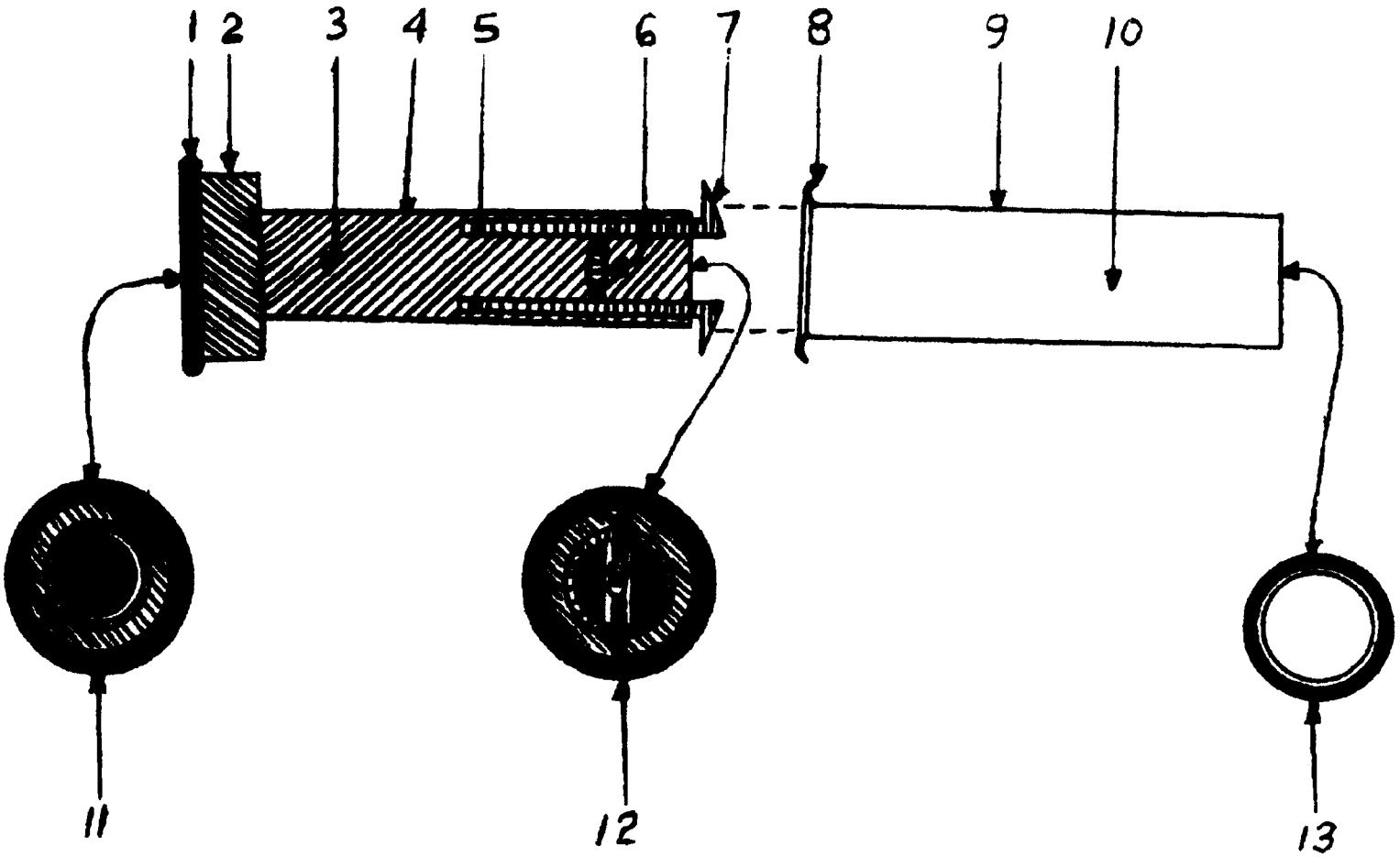
FIG. 1 is a side view of the firearm safety apparatus ejector and the firearm chamber safety block.

The present invention provides an improved firearm safety device, which is intended to save lives and gain widespread public acceptance. The invention, when implemented, is anticipated to impose only a minimal cash expenditure requirement to the buyer while providing an extremely stable firearm safety system that can be installed in a matter of seconds.

The firearm safety apparatus system is comprised of two parts, a tubular sleeve and a sleeve ejector. The tubular sleeve is inserted into an open firing chamber of a weapon and makes the weapon inoperable. The sleeve ejector is positioned through the tubular sleeve and becomes attached to the sleeve for extraction. When the firearm safety apparatus is extracted from the weapon's firing chamber the weapon is ready for use. The sleeve and ejector, when united, has the appearance of a regular shell and may be used as a firing chamber plug.

It is anticipated the Firearm Safety Apparatus can be used in most all weapons.

DETAILED DESCRIPTION OF THE DRAWINGS

FIG. 1—Page 1

The firearm safety block ejector 4 is designed to remove the chamber safety block 9 from the firing chamber of a weapon. The rim 1 is manufactured as part of the ejector cap 2 that is attached to the mounting stem 3. The ejector 4 is comprised of the rim 1, the ejector cap 2, mounting stem 3 and the ejector arms 7. The ejector 4, once placed in the chamber block, fits snugly. The ejection arms 7 are shown at the back of the ejector 4 as shown at character 12. The ejector arms 7 are spaced to the opposite side of the ejector tube 4 frame and horizontally affixed opposite the other and held in place by the ejector arm fasteners 5. The position of the ejector arms fasteners 5 is approximately half the length the ejector tube 4 frame. The mounting stem 3 end opposite the ejector cap 2 is slotted to accommodate the ejector arms 7, the ejector spring 6 and the ejector arm fasteners 5. After installation of the ejector arms 7 by fasteners 5 in the mounting stem 3 the ejector arm spring 6 forces outward tension on the ejection arms 7 allowing the arms to become retrievers when inserted through chamber block 9. Pressure applied to the ends of the ejector arm 7 prongs allow the ejector arms 7 to move inward while being placed in or removed from the passage of the chamber block 9. The chamber block 9 has an expanded orifice 8 on the end that receives the ejector 4. Once the chamber block 9 is placed in the firing chamber 18 the expanded orifice 8 is seated against the outside rim of the weapon's firing chamber 18. Being seated as such provides a limited entry to the firing chamber 18 and when the ejector 4 is inserted into the firing chamber 18 the expanded orifice 8 acts as a stop. The diameter of the chamber block 9 is greater than the diameter of the mounting stem 3 which allows the mounting stem 3 to be inserted through and locked to the chamber block 9. The circular end 13, of the ejector 4, allows attachment of the ejector arms 7. The expansion of the ejection arms 7 past the end of the circular end 13, of the ejector 4, locks the ejector 4 to the chamber block 9. The chamber block 9 is manufactured using tubular materials and fitted with a frictional skirt 10 to accommodate various caliber firearm chambers. The frictional skirt 10 allows the chamber block 9 to remain in a weapon's firing chamber until retrieved by the ejector 4. A front view 11 of the ejector 4 displays the profile of the ejector 4 as viewed from the rimmed 1 end. The rear view 12 of the ejector 4 depicts the location of the ejector arms 7, opposite each other and displays the spring 6 location. A back view of chamber block 9 is displayed by character 13.

FIG. 2—Page 1

Figure 2:
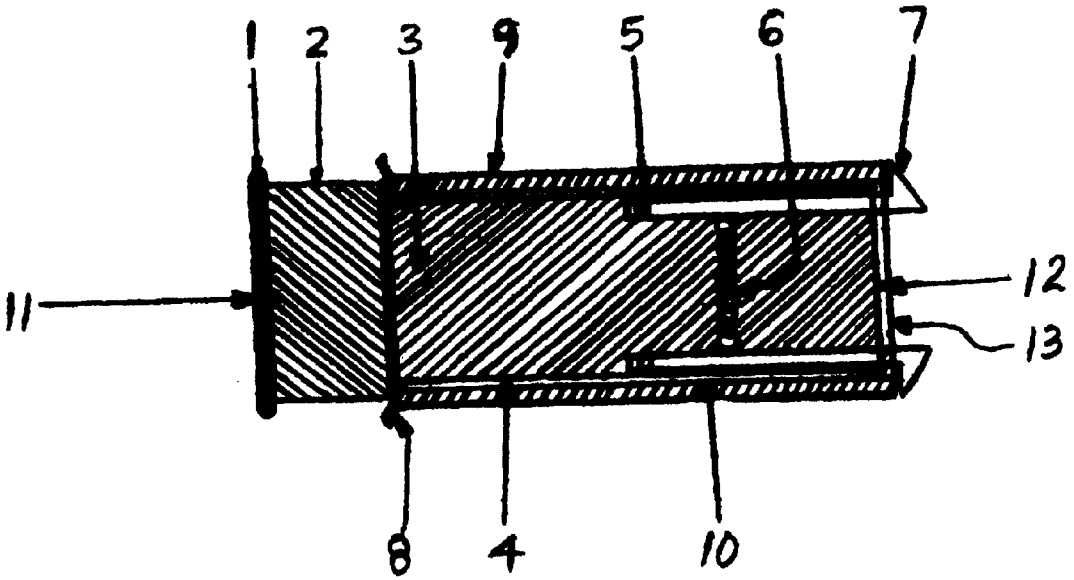
FIG. 2 is a side view of the firearm safety apparatus ejector and the firearm chamber safety block coupled together making one shell unit.

FIG. 2 provides a view of the firearm safety chamber block 9 as one complete unit affixed to the ejector 4. The ejector 4 is inserted through the cylindrical chamber block 9 and displays the ejection arms 7, opposite the other, attached in the ejection position n the back circular end of the chamber safety block 9. FIG. 2 discloses the appearance of the firearm safety block as it would appear after ejected from a weapon's firing chamber.

The disassembly of the unit, ejector 4 and chamber safety block 9, as displayed in FIG. 2, require a person to grasp the firearm safety block 9 and apply inward manual pressure simultaneously to the ejection arms 7. Once the ejection arms 7 are depressed and while still grasping the firearm chamber block 9, apply inward pressure toward the ejector cap 2 end, thus moving the ejector 4 from the expanded orifice 8 by pushing the ejector inward. To complete the removal of the ejector 4 from the firearm chamber block 9 grasp the ejector cap 2 and by pulling outward remove the ejector 4 from the chamber block 9.

FIG. 3—Page 1

Figure 3:
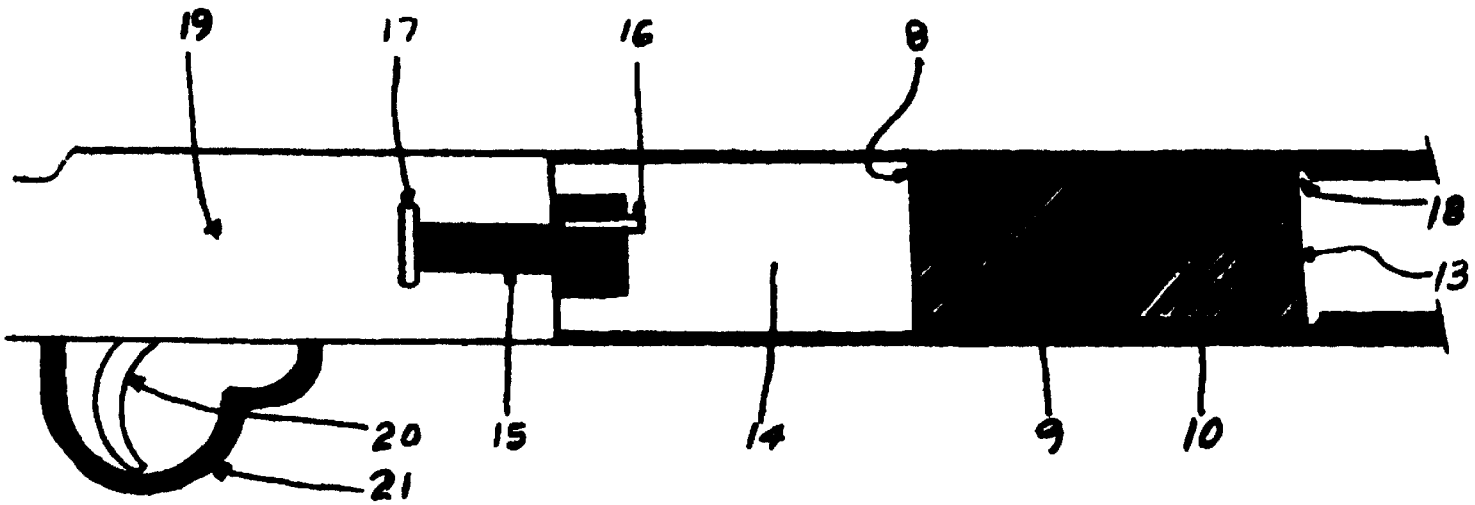
FIG. 3 is a side view of the chamber block placed in the firing chamber of a bolt action weapon.

FIG. 3 provides a drawing of a bolt action weapon with the chamber safety block 9 positioned in the weapon's chamber 18. By inserting backward pressure to the bolt handle 17 the bolt 15 will slide to the rear of the weapon's ejection port 14, and lock. When the bolt 15 is in the rear locked position the weapon's ejection port 14 is open and allows the chamber safety block 9 to be manually inserted into the weapon's firing chamber 18. The weapon is now in a blocked safety mode. A friction skirt 10 is manufactured and a part of the exterior of the chamber safety block 9. This frictional skirt provides a force from the chamber safety block 9 to the inner circumference walls of the firing chamber 18. The removal of the chamber block 9 is not permitted until the ejector 4 is inserted, fastened and ejected by using the weapon's bolt 15 and shell ejector 16.

FIG. 3 further displays the position of the expanded orifice 8 of the chamber block 9 positioned against the mouth of the firing chamber 18 thus disallowing the expanded orifice 8 end to enter into the chamber block.

Other items depicted on FIG. 3 drawings are the weapon's frame 19, weapon trigger 20, weapon trigger guard 21 and back of chamber safety block 13.

FIG. 4—Page 1

Figure 4:
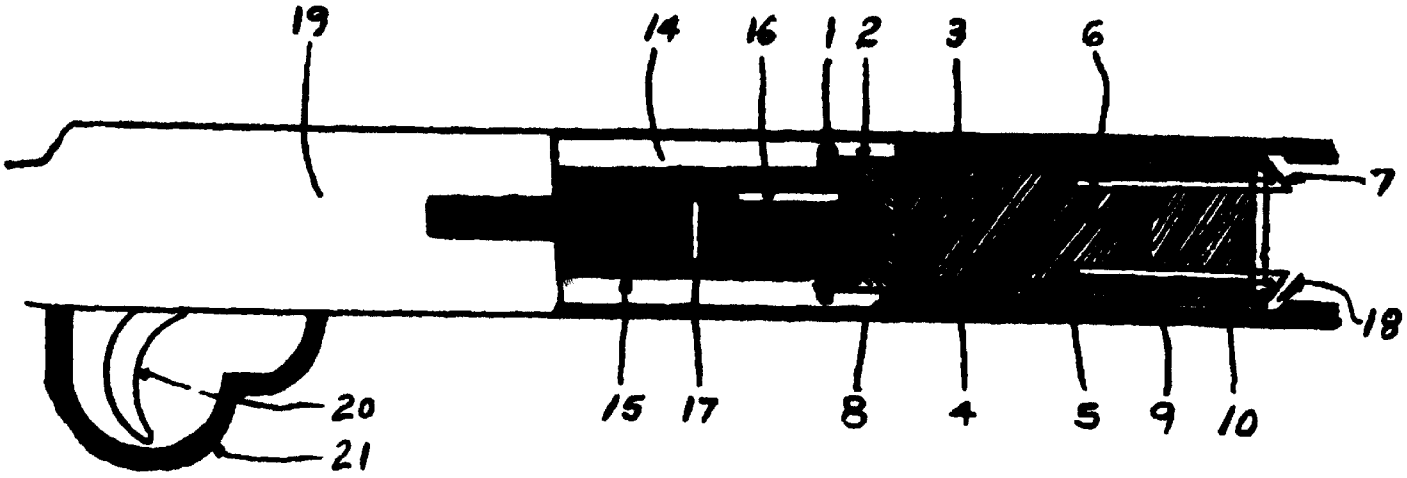
FIG. 4 is a side view of the firearm safety apparatus ejector and chamber block coupled together as one unit and in the position of being extracted from the firing chamber by the weapon's bolt and shell ejector.

FIG. 4 allows a view of a weapon frame 19 with the chamber safety block 9 positioned in a weapon's firing chamber 18. The shell ejector 16 is in place for shell ejection by the weapon's bolt 15. The shell ejector 16 has entrapped the raised rim 1 on the ejector cap 2 and by inserting rearward pressure on the bolt handle 17 the bolt 15 will be moved to rear in the weapon's ejection port 14, thereby allowing the shell ejector 16 to remove the chamber safety block 9 and the ejector 4 from the firing chamber 18.

The safety block ejector 4 and chamber block 9, as a unit, are extracted in the same fashion as a regular shell.

Other items listed on FIG. 4 are the mounting stem 3, ejection arm fasteners 5, tension spring 6, ejection arms 7, expanded orifice 8, friction skirt 10, trigger 20 and trigger guard 21.

What is claimed is:

1. A firearm safety apparatus that prevents a weapon having a firing chamber, muzzle, and a barrel from being fired comprising, in combination:

a hollow cylindrical chamber safety block positionable snugly in said firing chamber to prevent the insertion of a live round into said firing chamber;

an ejector cap having a raised rim inserted into said chamber safety block to allow ejection of the chamber safety block;

a mounting stem affixed to said ejector cap, said mounting stem comprises an ejector having ejector arms with pronged ends to assist in the removal of said chamber safety block from said firing chamber;

said firearm safety apparatus does not require the use of a rod to insert and remove said firearm safety apparatus from said weapon's muzzle and barrel;

said firearm safety apparatus further functions as a safety plug, and a lock and key system in which said chamber safety block is the lock and said ejector cap is the key.

* * * * *